US005775065A

United States Patent [19]

Tolson

[11] Patent Number: 5,775,065

[45] Date of Patent: Jul. 7, 1998

[54] METHOD AND APPARATUS FOR TRANSVERSE CUTTING AND SEALING FILM WRAPPED AROUND A PRODUCT

[75] Inventor: Sidney S. Tolson, Scotland Neck, N.C.

[73] Assignee: Ossid Corporation, Rocky Mount, N.C.

[21] Appl. No.: 847,020

[22] Filed: May 1, 1997

[51] Int. Cl.[6] ..... B65B 53/02; B65B 51/26; B65B 51/32

[52] U.S. Cl. ..... 53/479; 53/442; 53/554; 53/373.5; 53/374.6; 53/375.3; 53/372.3

[58] Field of Search ..... 53/442, 477, 481, 53/479, 463, 373.4, 373.5, 374.6, 374.8, 375.3, 371.6, 372.3

[56] References Cited

U.S. PATENT DOCUMENTS

| | | | |
|---|---|---|---|
| 4,574,566 | 3/1986 | Eaves et al. | 53/450 |
| 4,630,429 | 12/1986 | Christine | 53/375.3 X |
| 4,965,985 | 10/1990 | Masubuchi et al. | 53/375.3 X |
| 5,058,361 | 10/1991 | Schmacher | 53/371.4 X |
| 5,271,210 | 12/1993 | Tolson | 53/375.4 |
| 5,666,788 | 9/1997 | Tolson | 53/442 |
| 5,673,534 | 10/1997 | Fowler | 53/375.3 X |

*Primary Examiner*—Linda Johnson
*Attorney, Agent, or Firm*—Olive & Olive, P.A.

[57] ABSTRACT

Method of and apparatus for cutting and heat sealing a film with a smooth seam which extends substantially the transverse width of a wrapped package utilizes a mechanism having a cool clamping portion and a hot sealing portion which are sequentially actuated. The clamping portion, with segments upstream and downstream of a sealing position, is activated to firmly hold the film against a base plate. The sealing portion is located between the upstream and downstream segments of the clamping portion. The heated sealing portion is brought into contact with the film as a cutting member cuts the film. The sealing head is retracted as the clamping portion holds the film to allow longitudinal film shrinkage and prevent transverse film shrinkage of the film. The clamping portion separates and the next package in a succession of film-enclosed packages is moved downstream of the sealing position.

4 Claims, 5 Drawing Sheets

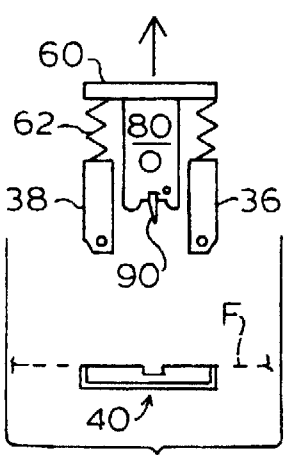
FIG. 7A
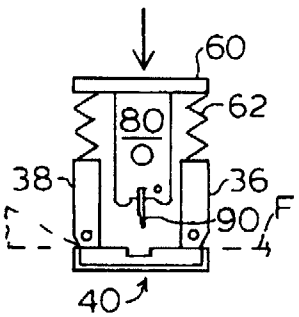
FIG. 7B
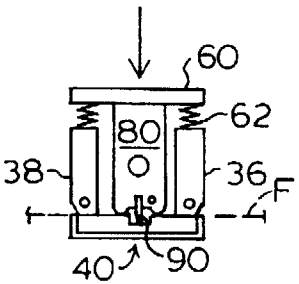
FIG. 7C
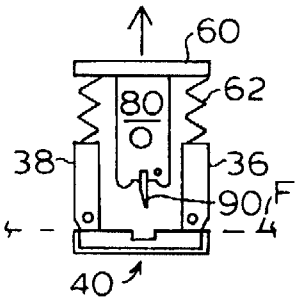
FIG. 7D
FIG. 7E

METHOD AND APPARATUS FOR TRANSVERSE CUTTING AND SEALING FILM WRAPPED AROUND A PRODUCT

BACKGROUND OF THE INVENTION

1. Field of the Invention

This invention relates generally to methods and apparatus for cutting and sealing heat sealable film wrapped around a product and more particularly to improved methods and apparatus for cutting and sealing heat sealable film wrapped around a product transversely between successive wrapped products.

2. Description of the Related Art

In the preparation of various products for market presentation to the consumer, many products are wrapped in a clear film to protect the product from the outside environment and yet permit handling and product visibility. Common among the products which are so wrapped are food items, especially meats, including poultry parts. The packaging of meats and poultry parts for sale is frequently done with a film which can be shrunk when heated. The shrinking helps to achieve a smooth and attractive appearance of the packaged product by pulling the film tightly around the product.

In the process of wrapping products such as those which are the subject of the invention, a sheet of heat sealable film of continuous length is formed into an elongate tubular configuration, in some instances with the aid of a "former", as disclosed in U.S. Pat. No. 4,574,566 to Eaves et al., the teachings of which are incorporated herein by reference. In this process, for example, a series of products are wrapped into a film tube in linear alignment generally along the axis of the tube and are longitudinally (used herein to indicate a direction parallel to the tube axis) spaced apart from one another. A longitudinal seam is formed by joining the opposed edges of the film sheet, and a transverse (used herein to be normal to the tube axis) seam is formed between each of successive products by means of heat and pressure. As each transverse seam is sealed, the heating substantially melts the film so that the leading packaged products separates from the trailing packaged product. The '566 patent also discloses a sealing apparatus for forming a transverse seam in the film tube between sequential products. The device disclosed in the '566 patent includes a pair of opposed rotary sealing heads which are caused to revolve so as to match the direction and linear speed of the product and tube as portions of the sealing heads press upper and lower surfaces of the tube together and apply heat.

Another film wrapping device employing an arrangement for the operation of sealing bars for producing transverse seams is disclosed in U.S. Pat. No. 5,271,210 to Tolson, the teachings of which are also incorporated herein by reference. In the apparatus described in the '210 patent, a pair of opposed linear sealing bars are moved vertically and are brought into contact with the upper and lower surfaces of the film tube as the sealing bars are conveyed synchronously with the products and the tube. This action results in the contact time between the sealing bars and the film tube being maximized without slowing the speed of product conveyance. The sealing bars are then separated vertically and conveyed in the opposite direction back to their starting point. Depending on the product being wrapped and film being used, this equipment can be operated as fast as 70 products packaged per minute.

The '210 patent also discloses a pair of vertically oriented lateral control belts associated with the sealing bars. The belts are mounted and initially driven so as to be able to move linearly in a direction opposite to that in which the products are moved. The belts rotate in the direction of the product movement and move linearly in the same direction as the products move when the sealing bars are separated and are returning to their upstream position and while the next product is moved past the sealing bars. The lateral control belts move linearly in synchronization with the products without belt rotation while the sealing bars are pressed together to seal the transverse seam.

Sealing of two portions of heat sealable film typically involves heating one or both portions to near the melting point and pressing the two portions together. A common problem encountered due to the sealing heat applied is that of film shrinkage in either or both the longitudinal and transverse directions of the film. This shrinkage problem has been dealt with in a variety of ways, as next will be described.

Known methods and apparatus for sealing film includes forming a transverse seam between successive packages and using a clamp or clamps with circulating cooling fluid. A first known and typical film sealing method and apparatus uses a cooled clamp in conjunction with an electrical resistance heating wire in a manner to instantaneously heat and deactivate the wire while continuing to hold the film with the cooling clamps. This generally results in a transverse seam being formed without allowing longitudinal shrinkage in the film.

A second known film sealing method and apparatus utilizes a pair of clamping jaws flanking a heat sealing element upstream and a second such apparatus downstream of a film-parting element. This second known method and apparatus prevents the film from shrinking in both the longitudinal and the transverse directions.

A third known film sealing method and apparatus employs spring-mounted cooled clamps and a rigidly mounted heated sealing bar which are all mounted to a common carrier bar. This third known method and apparatus for sealing film, that unitizes a heated sealing bar for separating the film has been used in a Model 500E packaging machine, sold by Ossid Corporation of Rocky Mount, N.C.

In the majority of prior known film sealing apparatus and methods severing the film between packages is accomplished by heat. A ridge, typically positioned between a pair of sealing bars, is heated to a temperature sufficient to melt through, or sever, the film. It is known that substantially higher temperature is needed to melt through and part the film than is needed to soften the film to seal a seam Other prior art devices have been known to utilize a knife for cutting the film and a pair of heated bars for sealing the film. The knife cuts the film, as distinguished from a heated wire or heated ridge which melts through the film. Representative apparatus having a cutting knife used to cut film are seen in U.S. Pat. Nos. 4,574,566 to Eaves et al.; 4,525,977 to Matt; 4,506,488 to Matt et al.; 4,299,075 to Gram; 4,106,265 and 4,106,262 to Aterianus; 4,807,420 to Barker; and 2,605,597 to Scheib. The present invention recognizes that the temperature of the sealing bars in such a machine which is sufficient to form a seam in the film is not as high as the temperature required to melt through, or sever, the film. Nothing in the known prior art has disclosed use of a cool clamp in conjunction with a knife, as disclosed herein and constituting a major improvement provided by the present invention. The present inventor has however himself disclosed the use of a pair of cool clamps combined with heated sealing bars in his presently pending application Ser. No. 08/633,175. While this prior application is directed to a system including cool clamps for improving the sealed seams, it did not incorporate a knife for film cutting. The present invention recognizes that use of a knife blade for film cutting achieves the beneficial results of seam smoothness, seam uniformity and machine operating speed by allowing the sealing bars to be operated at a significantly lower temperature than that required for severing the film. The lower temperature achieved manifests itself in terms of reduced film shrinkage and faster seam cooling, which translates to faster machine operating speed.

A particularly effective film for use in shrink-wrapping is a film which prior to being used as a wrapping film has been oriented, or work stretched, in two perpendicular directions. This type of film, known as bi-axially oriented film, when subjected to heat, shrinks bi-axially, thus removing wrinkles in both directions. Such a bi-axially oriented film is supplied by the Cryovac Division of W. R. Grace Chemical Co., Inc. as style SSD-310. The degree of shrink is proportional to the degree of orientation and of the heat applied. Hereafter, the term "film" shall pertain to mean oriented film. If a film is wrapped around a product, it is typically constrained and is not able to shrink to the extent it would if left unconstrained. Consequently, a residual component of film tension is created in the film.

Typically, poultry products are handled and wrapped while frozen or semi-frozen (firm) at a temperature of about −15° C. (5° F.). These same poultry products are displayed in a retail store at a temperature sufficient to maintain freshness and enhance appearance, i.e., 1° C. (34° F.). Thus, both the sealing system and the film employed must accommodate to a wide range of temperatures.

The longitudinal seam formed along the bottom of the package is considered to be generally uniform and satisfactory. However, according to all known heat sealing apparatus and methods, seal integrity of the transverse seam is marginal and fairly irregular in form. The invention disclosed herein provides an improved heat sealing and film cutting apparatus and method to produce a smooth, uniform and reliable transverse seam.

The major shortcomings of the prior art with regard to forming transverse seams involve the excessive heat applied to the film in most equipment because of the need to sever the film with heat. By having the sealing bars at a virtually identical temperature to the temperature of the hot-severing ridge, more heat is applied to the seam area than is required for sealing. This results in a considerable tendency to shrink the film around the seam, and occasionally to melt a hole through this film. Other systems which have been known to utilize a knife to cut the film still create film shrinkage due to the application of heat to the shrinkable film which is not mechanically immobilized, e.g., by clamps.

It is therefore an object of this invention to provide a method and apparatus able to produce a smooth and uniform transverse seam in a film tube in which products are wrapped.

It is a further object of this invention to provide a method and apparatus able to increase the operating speed in a film wrapping and sealing machine.

Other objects and advantages will be more fully apparent from the following disclosure and appended claims.

SUMMARY OF THE INVENTION

The present invention provides a method and apparatus for cutting and sealing film in which a cooled clamp upstream and a cooled clamp downstream of a sealing position are first brought into clamping contact with the film tube upper surface to squeeze the film tube and press the film tube lower surface into clamping engagement against a fixed base plate at a position between the products to force the film tube closed. The clamps hold the film tube against longitudinal, or transverse movement after which a cutting blade and a pair of upstream and downstream sealing bars are brought into contact with the film. The cutting blade cuts the film between successive products as the sealing bars seal the film on each side of the separating line. The cutting blade and sealing bars next move off the film to leave the cooled clamps holding the film as the seams cool. The clamps are then retracted and the apparatus cycles to form a subsequent seam.

BRIEF DESCRIPTION OF THE DRAWINGS

FIGS. 7A–7E represent a simplified schematic diagram of the operative steps taken by the sealing apparatus according to this invention.

DETAILED DESCRIPTION OF THE INVENTION

Figure 1:
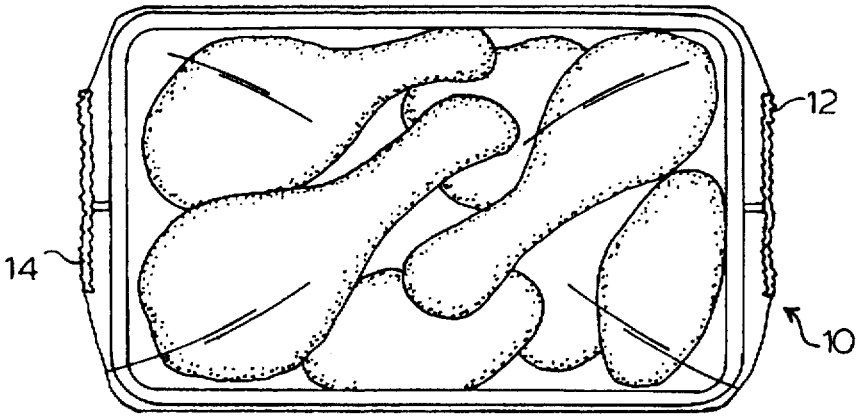
FIG. 1 PRIOR ART
FIG. 1 is a top plan view of a film wrapped product having transverse end seams typical of the type produced by a sealing apparatus and method of the prior art.

A typical illustration of the problem to which the present invention is directed appears in FIG. 1, wherein leading transverse seam 12 and trailing transverse seam 14 of package 10, produced by a prior art machine and method, are portrayed as being irregular and also as being narrower in the transverse direction than the width of package 10. In other prior art examples, the transverse seams of packages may have portions which are not sealed or are poorly sealed, thus causing a leak in the film envelope, whose primary purpose is to provide product protection.

It is well known that the application of heat, for example heat transmitted from a cutting ridge and sealing bars will cause some degree of film shrinkage to occur, and that the degree of shrinkage, assuming the same film properties, is proportional to the amount of heat. The instant invention recognizes that since a lower temperature is needed to seal a film than to sever it, a sealing apparatus which operates at no more than the temperature required for sealing will minimize the associated shrinkage, and a superior quality seam can be formed.

In contrast to seams 12 and 14 illustrated in FIG. 1, a seam formed by the apparatus and method of the present invention is relatively smooth and straight, providing greater integrity and product protection. Such a wrapped and sealed product is shown in FIG. 2 in which product 20 has leading seam 22 and trailing seam 24, both of which are smooth and straight and extend transversely for substantially the full width of product 20.

Figure 2:
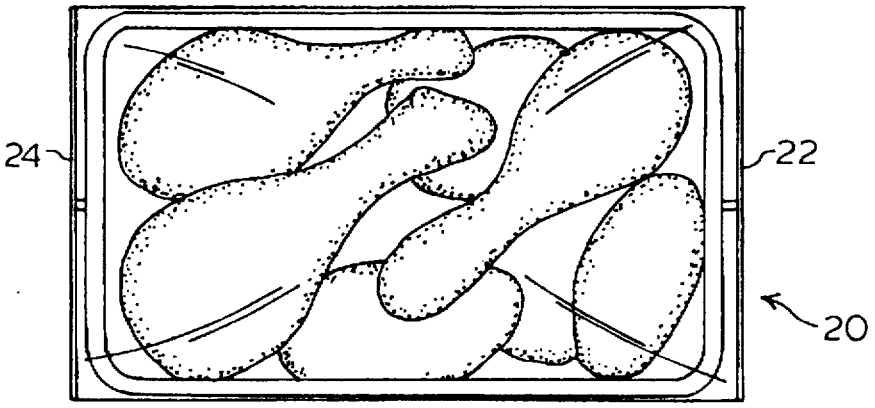
FIG. 2 is a top plan view of a film wrapped product with end seams formed according to the present invention.
Figure 3:
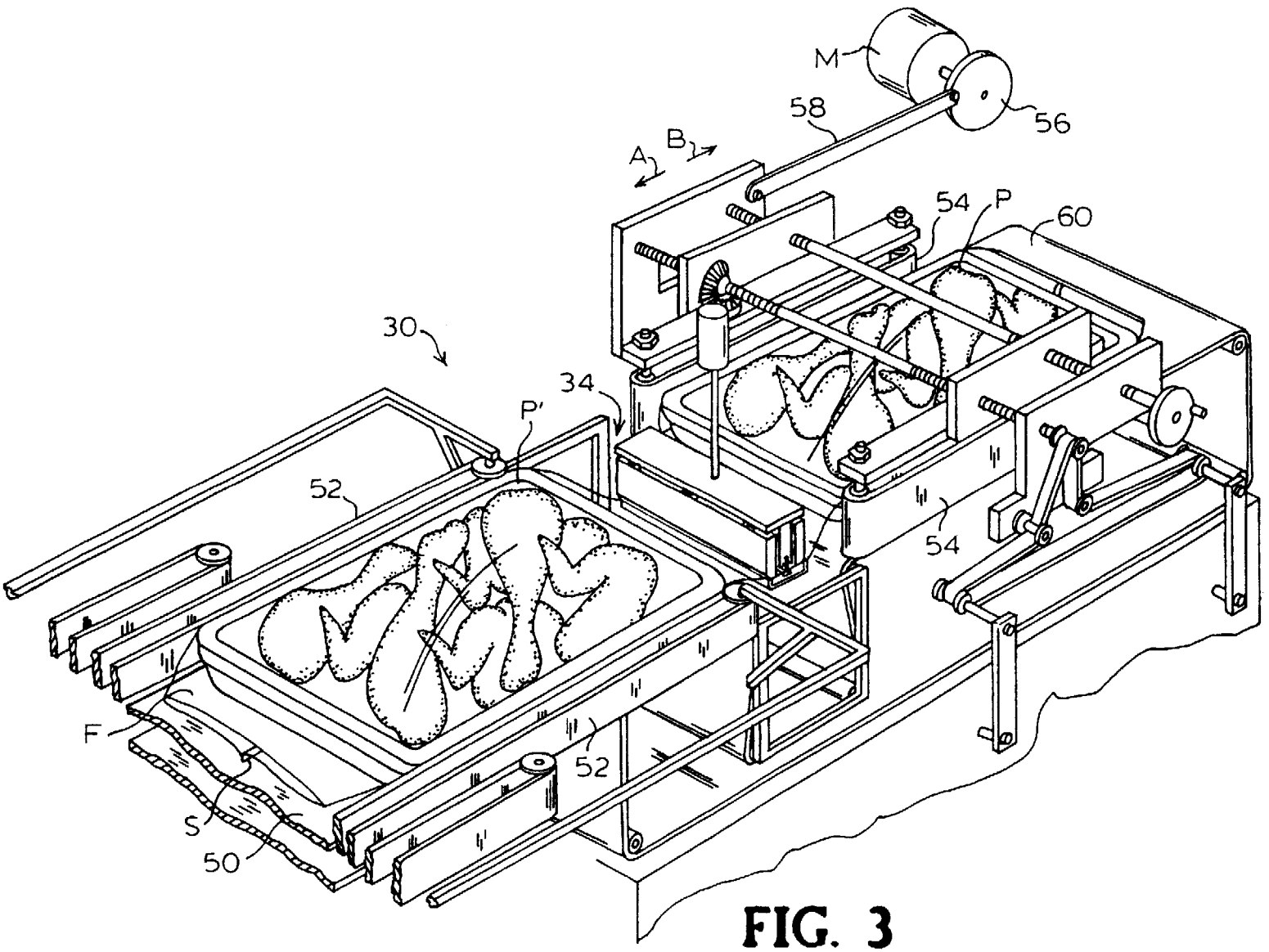
FIG. 3 is a perspective view of a portion of a machine similar to that disclosed in U.S. Pat. No. 5,271,210 for wrapping a product in a heat shrinkable film including the cutting and sealing apparatus of the present invention.

According to the objects outlined above and the seam quality improvement depicted by a comparison of FIG. 1 and FIG. 2, the present invention is practiced with a machine 30 for wrapping a product in a heat shrinkable film, illustrated in FIG. 3. The features of the present invention are embodied in the operation of sealing mechanism 34, the balance of the machine being substantially known in the art. Referring to FIG. 3 for purposes of description, the upstream direction is indicated by arrow A and the downstream direction by arrow B. Wrapping machine 30 has a horizontally oriented input conveyor 50 which sequentially transports a series of longitudinally separated products, represented as P, P', in a downstream direction as shown by arrow B. As products P, P' are transported downstream, film F in continuous sheet form is drawn from a film supply (not shown) and formed into a generally tubular configuration to enclose the series of products P, P' in sequence. A typical product to be wrapped in such film is, for example, a tray packed with poultry parts. Heat and pressure are applied by known apparatus, such as sealing wheels, to seal the opposed longitudinal edges of sheet film F together beneath products P, P' to form longitudinal seam S. Longitudinal seam S (FIG. 3) runs generally parallel to the longitudinal axis of the film tube and generally along the bottom of each sequential product P, P'.

Figure 4:
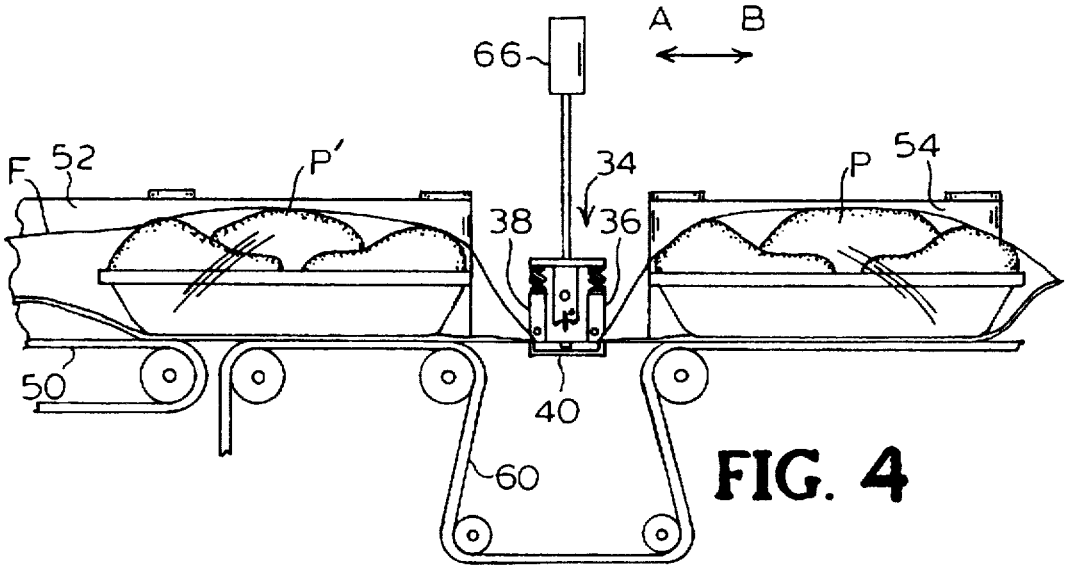
FIG. 4 is a partial side elevation view of the wrapping machine of FIG. 3 with the wrapping film held under tension between a pair of upper film clamps and a lower base plate and showing a cutting member which is positioned out of contact with the film prior to the initiation of cutting and sealing.

A pair of transverse seams are formed by sealing film F across the film tube at a position between successive products P, P' by sealing mechanism 34 (see FIGS. 3 and 4). Each transverse seam becomes a part of the wrapping of a respective leading or trailing product P, P'. Clamps 36, 38 of sealing mechanism 34 are pressed into contact with the upper surface of film tube F which is then pressed against base plate 40 to secure upper and lower portions of film tube F while the entire sealing mechanism 34 is moving downstream (in the direction of arrow B) in synchronization with the movement of film F. While clamps 36, 38 are firmly holding film F, the cutting and sealing of film F is effected as will be more fully described below. At the completion of the sealing cycle, clamps 36, 38 are retracted so as to be out of contact with film F to assume their initial positions, and the entire sealing mechanism 34 is returned upstream in the direction shown by arrow A as next sequential product P' passes between film clamps 36, 38 and base plate 40 for another transverse cutting and sealing operation.

Referring again to FIG. 3, vertically oriented upstream control belts 52, together with horizontally oriented input conveyor 50 move product P', wrapped in film F, sequentially toward sealing mechanism 34. Product P is shown as already having moved past sealing mechanism 34. Control belts 52 firmly grip the side surfaces of each of sequential products P, P' as product contacting surfaces of control belts 52 are extended and retracted in length. By this belt extending motion, the downstream end of each control belt 52 remains in relatively close proximity to oscillating sealing mechanism 34 to maintain control of the position and travel of each product P, P' until a transverse seam has been completed between each successive pair of adjacent products. Similar cyclic motion occurs with reciprocating, vertically oriented, downstream control belts 54 which are moved cyclically in synchronization with upstream side belts 52 by driver M through eccentric 56 and connecting link 58. Driver M may be a motor or a speed reducer which is driven from a main motor (not shown) of wrapping machine 30. As described in the '210 patent, reciprocating downstream control belts 54 are driven in such manner as to revolve when moving in an upstream direction (arrow A) and to not revolve when moving in a downstream direction (arrow B). In the example illustrated, input conveyor 50, gapped horizontal conveyor 60, and the pairs of vertical control belts 52 and 54 are driven at the same linear speed.

Referring now to FIG. 4, the present invention recognizes that any material is considerably weaker when heated to a temperature near its melting point than when it is cool. In the operation of wrapping and sealing film F around a series of sequentially presented products, as shown in side elevation in FIG. 4, film F is generally under longitudinal tension in the space between successive products P, P'. In this tensioned condition, when heated, bi-axially oriented film F tends to shrink both transversely and longitudinally and pull apart between adjacent products if subjected to heat-induced cutting or severing. Such longitudinal tension between successive products tends to cause film F to be drawn so as to be narrower in the transverse dimension than the width of product P, P'. According to the prior art devices, the resultant seams are typically like those illustrated in FIG. 1.

Figure 5:
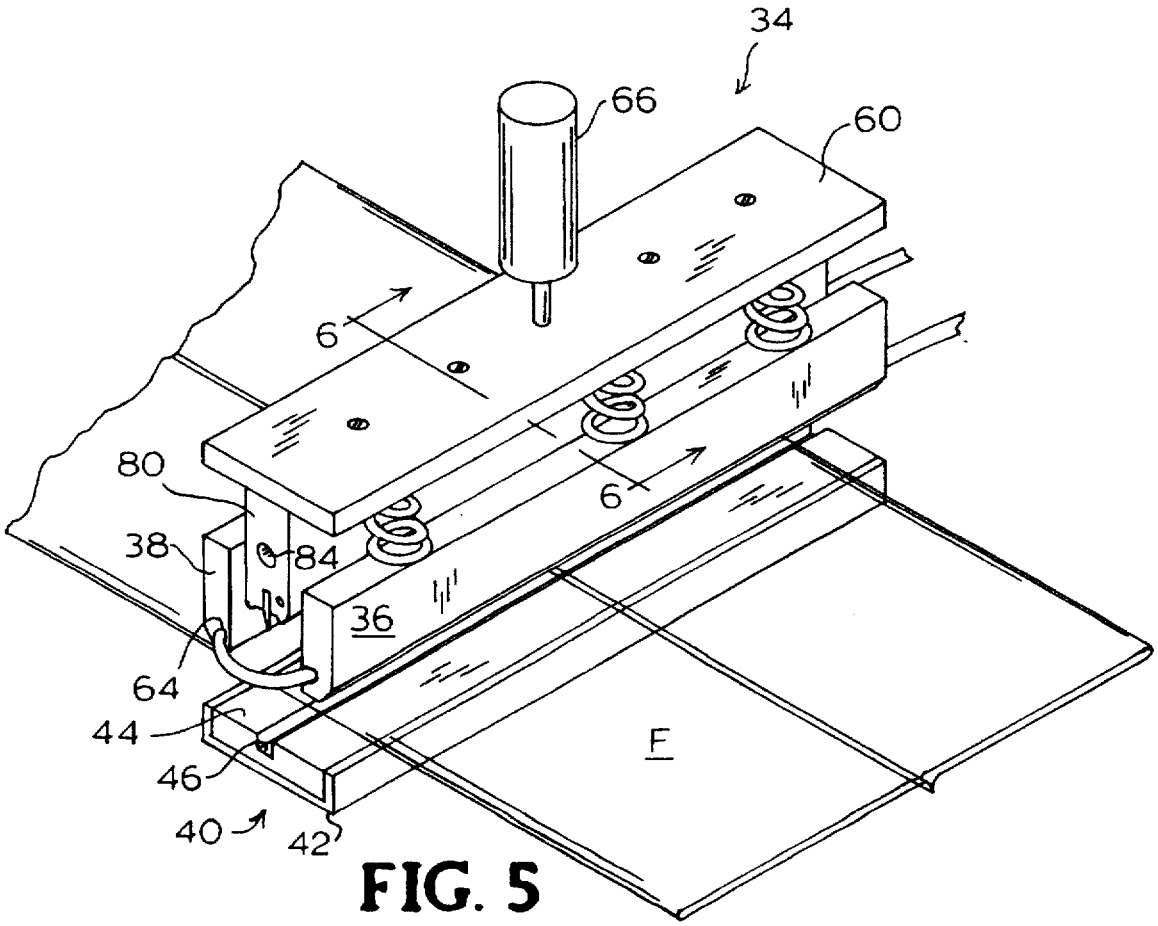
FIG. 5 is an enlarged perspective view of the clamping, cutting and sealing mechanism according to the invention.
Figure 6:
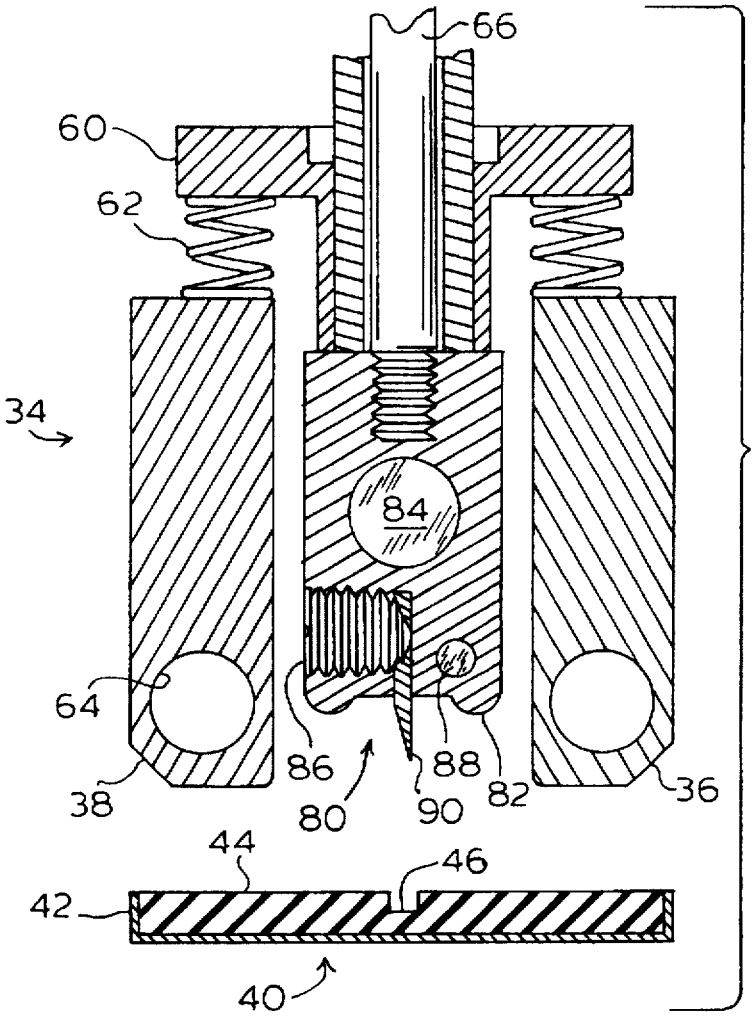
FIG. 6 is a cross sectional view of the clamping, cutting and sealing mechanism of the invention taken in the direction of line 6—6 of FIG. 5.

Referring now to FIG. 5 and FIG. 6, the preferred embodiment of a sealing apparatus of the invention is illustrated in perspective view in FIG. 5 and in cross sectional view in FIG. 6. The upper portion of sealing mechanism 34 includes clamping members 36 and 38 which are mounted on carrier bar 60 by resilient connectors 62, for example compression springs. FIG. 5 shows a driver 66, such as a pressure-actuated cylinder, a servomotor, or the like, connected so as to move carrier bar 60 vertically. A coolant channel 64 is connected from a coolant source (not shown) to circulate a coolant through each of the clamping members 36, 38. A heated sealing head 80 is mounted rigidly to carrier bar 60 by screws or other means, and is positioned between cooled clamp members 36, 38 with a minimal space maintained therebetween with either air or a barrier material (not shown) to serve as a thermal insulator. Sealing head 80 and base plate 40 are positioned to engage opposite surfaces of film F and apply pressure against each other at a seal position as film F is being securely held therebetween. According to the devices shown in FIGS. 3 and 4, sealing mechanism 34 forms a seal transversely across film F between each pair of products P, P'. The sealing mechanism illustrated in FIG. 6 is configured to be symmetrical about the line at which cutting blade 90 will separate film F between sequential products. Clamps 36, 38 are cooled by coolant material circulating through coolant channels 64 so as to be kept well below the temperature at which film F will be softened. Sealing head 80 is maintained at an elevated temperature sufficient to seal, but not sever portions of film F by heat source 84, for example an electrical cartridge heater. The operation of heat source 84 is regulated by means of thermal probe 88, positioned close to a sealing bar 82. A pair of protruding sealing bars 82 are formed on the lower surface of sealing head 80 so as to clearly delineate the seam being created. As noted above, the temperature needed to seal film F is substantially lower than the temperature needed to sever it. Since the separating of sequential products is done by cutting, rather than thermal means, the temperature of sealing head 80 may be kept as much as 55° C. (100° F.) lower than in previously known methods while maintaining desired production speeds. Alternatively, if the temperature of sealing head 80 were higher, the operating speed could be proportionally increased.

Referring still to FIG. 6, the cutting blade 90 is elongate and substantially planar, having its cutting edge formed with a series of parallel points (not shown), commonly known as a serrated edge. Such a serrated edge provides a plurality of points which penetrate film F simultaneously to form a uniform cut. Blade 90 has a series of depressions to receive the points of set screws 86 to secure blade 90 into sealing head 80.

Still referring to FIG. 6, base plate 40 is positioned below and opposite to sealing mechanism 34 and is wide enough to engage both clamping members 36, 38. Base plate 40 comprises resilient pad 44 which is supported by channel 42 and extends transversely across the width of sealing head 80. Pad 44 is formed with slot 46 longitudinally along a midline thereof to a depth less than the thickness of pad 44 to avoid exposing channel 42. The cutting edge of blade 90 is positioned to enter slot 46 approximately as sealing bars 82 contact the upper surface of pad 44. In the preferred embodiment, pad 44 is formed of a cured silicone rubber. The other machine components are formed of stainless steel.

Referring now to FIGS. 7A–7E, the underlying principles of the method of the invention are illustrated schematically. Product-filled packages are not included in these drawings for clarity of illustration. The series of sequential operations in FIGS. 7A–7E are depicted by schematic end elevation views of the sealing mechanism of FIGS. 5, 6 performing the major steps of the method of the invention, progressing from left to right. Film F is shown in FIG. 7A as being two separate layers which become pressed together in FIGS. 7B–7E. The sealing mechanism comprises clamp members 36, 38, resilient connectors 62, and sealing head 80, and the lower portion comprises base plate 40. While the method of this invention is described as being intended for use with sealing bars being moved cyclically in an upstream and downstream direction in synchronization with the movement, for example, of products P, P' according to the teaching of the '210 patent, use with other sealing apparatus such as rotating sealing apparatus, for example, is considered within the scope of the invention.

The first step of the sealing cycle is shown in FIG. 7B, as carrier bar 80 moves partially toward base plate 40 so that clamp members 36, 38 press the two layers of film F into contact, and while sealing head 80 remains remote from base plate 40. Resilient connectors 62 remain substantially fully extended. At this stage film F is held for a short time so as to be immobile relative to sealing head 80, although it should be understood that the entire sealing mechanism and the film are moving in a downstream direction (from left to right as shown). In the illustration of FIG. 7C, clamp members 36, 38 remain in firm contact with film F, carrier bar 60 moves farther downwardly, compressing resilient connectors 62, and sealing head 80 and base plate 40 are brought into contact with the film under pressure to sealingly join the two layers of film F as cutting blade 90 separates film F between the formed seams. The coolant circulating through each clamp member keeps the clamp members well below the film's melting temperature so that film F will not stick to, or be significantly weakened by contact with, clamp members 36, 38.

In FIG. 7D, sealing head 80, having applied heat and pressure to film F, are moved apart by a partial separating movement of carrier bar 60 while clamp members 36, 38 remain in contact with film F for a relatively long time as a coolant continues to circulate therethrough. The heat causes a longitudinal shrinkage of film F so that each seam approaches respective clamp members 36, 38. Cooled clamp members 36, 38 maintain pressure on film F until film F has cooled substantially below its melting temperature so that substantially no transverse shrinkage of film F occurs. The resultant seam is virtually wrinkle-free.

The clamp members 36, 38 are moved apart as illustrated in FIG. 7E after the formed seam has been cooled and stabilized. Since the machine sealing operation is cyclical, the positions of the components as shown in FIG. 7A and FIG. 7E actually represent the same point in each cycle. A sequential product (not shown) moves past the sealing mechanism while the upper and lower parts thereof are separated as in FIGS. 7A, 7E. The resultant seam is comparatively strong, smooth and substantially as wide as product P, P', as seen in FIG. 2.

The apparatus and method of this invention has been described and illustrated by means of a preferred embodiment for purposes of example. It is recognized that numerous variations to the above described invention may be generated, which are considered to be within the scope of spirit of the present invention. It is also appreciated that other modifications to the invention will become apparent to those skilled in the art and which modifications are intended to be incorporated herein.

What is claimed is:

1. A method for cutting and sealing a heat shrinkable film transversely between successive film wrapped products, comprising the steps of:

(a) clamping said heat shrinkable film transversely with first cooled clamping means at a position upstream and second cooled clamping means at a position downstream of a transverse sealing position;

(b) providing a sealing head having a pair of protruding sealing bars;

(c) heating said sealing head so as to cause said sealing bars to attain a temperature sufficient to seal said heat shrinkable film;

(d) contacting said heat skrinkable film at said sealing position with said sealing bars so as to apply sufficient pressure to seal said heat shrinkable film;

(e) cutting said heat shrinkable film with a cutting member maintained at a temperature lower than needed to thermally sever said film and fixedly positioned between said sealing bars so that a first of said successive film wrapped products is cut apart from a second of said successive film wrapped products;

(f) retracting said sealing bars and said cutting member from contact with said heat shrinkable film;

(g) allowing said heat shrinkable film upstream and downstream of said sealing position to shrink in a longitudinal direction away from said sealing position while maintaining said first and second cooled clamping means in clamping contact with said heat shrinkable film;

(h) restraining said heat shrinkable film from shrinking in a transverse direction; and (i) unclamping said heat shrinkable film by retracting said first and second cooled clamping means.

2. The method as described in claim 1, further comprising the step of moving apparatus for performing the steps described in claim 1 in a downstream direction while said heat shrinkable film is clamped and moving said sealing mechanism in an upstream direction during the time said heat shrinkable film is unclamped.

3. Apparatus for cutting and sealing a heat shrinkable film transversely between successive products being conveyed in a selected direction for being wrapped in said film, comprising:

(a) an elongate carrier bar mounted transversely to said selected direction in a manner to be moved vertically;

(b) means to incrementally move said carrier bar vertically;

(c) a pair of spaced apart elongate cooled clamps mounted to said carrier bar in parallelism thereto so as to contact said film when said carrier bar is moved vertically downward by a first increment;

(d) an elongate base plate mounted opposed to said cooled clamps in a manner so that said film will be pressed between said cooled clamps and said base plate when said carrier bar is moved vertically downward to a first selected position;

(e) an elongate heated sealing head mounted to said carrier bar between and parallel to said pair of cooled clamps;

(f) a pair of protruding elongate sealing bars formed on a lower surface of said heated sealing head in a position to press against said base plate and seal a leading and a trailing end of said film pressed between said cooled clamps and said base plate when heat sufficient to seal said film is transmitted to said sealing bars; and (g) an elongate cutting blade removeably mounted to said heated sealing head in a fixed position to cut said film pressed between said cooled clamps and said base plate in a position between and parallel to said sealing bars.

4. The apparatus of claim 3 in which the base plate is formed with an elongate slot substantially aligned with the length of said base plate.

* * * * *

UNITED STATES PATENT AND TRADEMARK OFFICE

CERTIFICATE OF CORRECTION

PATENT NO. : 5,775,065
DATED : July 7, 1998
INVENTOR(S) : Sidney S. Tolson

It is certified that error appears in the above-identified patent and that said Letters Patent is hereby corrected as shown below:

Title page, item [57],

In the Abstract, lines 3 and 14, change "package" to read --product--.

In the Abstract, line 15, change "packages" to read --products--.

Column 1, line 40, change "products" to read --product--.

Column 4, line 34, change "a" to read --an enlarged--.

Column 6, line 25, after "in" (second appearance) insert --enlarged--.

Signed and Sealed this

Twenty-second Day of September, 1998

*Attest:*

*Attesting Officer*

Bruce Lehman

BRUCE LEHMAN

*Commissioner of Patents and Trademarks*